US007723934B2

(12) United States Patent
Adam et al.

(10) Patent No.: US 7,723,934 B2
(45) Date of Patent: May 25, 2010

(54) METHOD FOR CONTROLLING AN AUTOMATIC DEVICE FOR CLEANING A SURFACE IMMERSED IN LIQUID AND CORRESPONDING CLEANING DEVICE

(75) Inventors: Pascal Adam, Ayguesvives (FR); Phillippe Pichon, Villenueve de Riviere (FR)

(73) Assignee: Zodiac Pool Care Europe S.A.S.U. (FR)

( * ) Notice: Subject to any disclaimer, the term of this patent is extended or adjusted under 35 U.S.C. 154(b) by 521 days.

(21) Appl. No.: 10/582,755

(22) PCT Filed: Dec. 17, 2004

(86) PCT No.: PCT/FR2004/003292

§ 371 (c)(1),
(2), (4) Date: Apr. 25, 2007

(87) PCT Pub. No.: WO2005/061822

PCT Pub. Date: Jul. 7, 2005

(65) Prior Publication Data

US 2007/0272274 A1 Nov. 29, 2007

(30) Foreign Application Priority Data

Dec. 19, 2003 (FR) ..... 03 15070

(51) Int. Cl.
*H02P 1/00* (2006.01)

(52) U.S. Cl. ..... 318/280; 318/434; 318/433

(58) Field of Classification Search ..... 318/280, 318/434, 432, 433, 466, 282
See application file for complete search history.

(56) References Cited

U.S. PATENT DOCUMENTS

| | | | |
|---|---|---|---|
| 3,753,265 | A | 8/1973 | Wulc |
| 4,162,557 | A | 7/1979 | Rasmussen |
| 5,507,058 | A | 4/1996 | Minami |
| 6,299,699 | B1 | 10/2001 | Hanan |

(Continued)

FOREIGN PATENT DOCUMENTS

| | | |
|---|---|---|
| EP | 0 905 334 | 3/1999 |

(Continued)

*Primary Examiner*—Karen Masih
(74) *Attorney, Agent, or Firm*—Dean W. Russell; Kristin M. Crall; Kilpatrick Stockton LLP

(57) ABSTRACT

The invention relates to a method for controlling an automatic device for cleaning a surface immersed in liquid which comprises electric motors for driving a chassis along a cleanable surface. The inventive method consists in periodically measuring at least one electrical quantity which makes it possible to obtain the representative value of the resisting torque of at least one driving electric motor (7), in comparing each obtained value with the predetermined threshold representative value of a maximum acceptable value and, when said value is greater than said threshold value for the driving electric motor (7), a procedure known as a protection procedure is started. Said procedure consists in inverting the control of at least said driving electric motor (7) in such a way that the device is displaced in a direction opposite to the initial displacement direction and in controlling the device displacements in such a way that it follows the path enabling said device to deviate from the initial path which it followed when said threshold value was exceeded.

11 Claims, 1 Drawing Sheet

U.S. PATENT DOCUMENTS

2005/0123408 A1* 6/2005 Koehl ..... 417/53

FOREIGN PATENT DOCUMENTS

Figure 1:
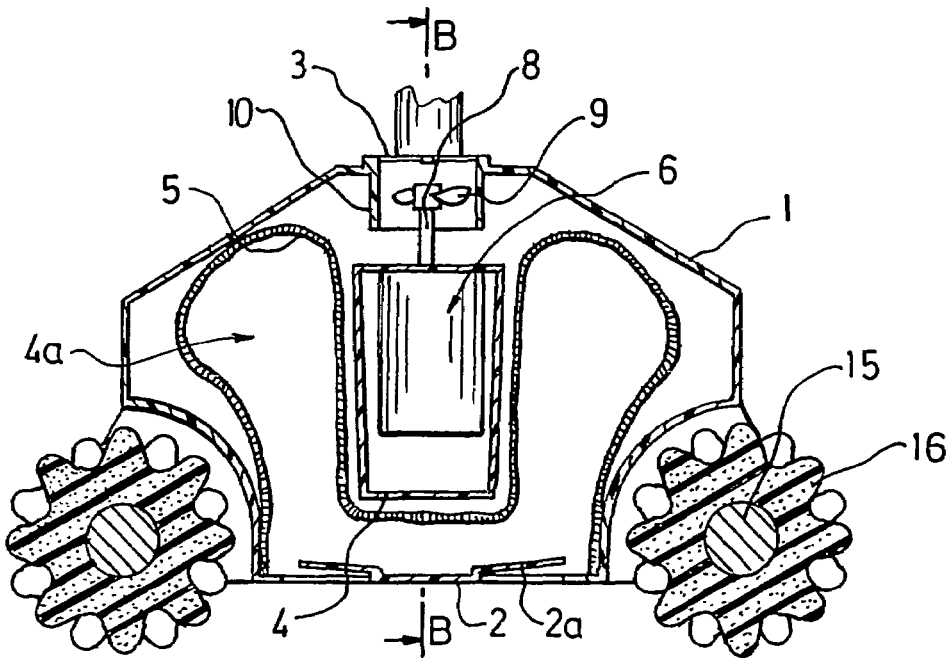

EP 1 277 897 1/2003
FR 2 567 552 1/1986
FR 2 818 680 6/2002
WO WO 2005/061823 7/2005

* cited by examiner

METHOD FOR CONTROLLING AN AUTOMATIC DEVICE FOR CLEANING A SURFACE IMMERSED IN LIQUID AND CORRESPONDING CLEANING DEVICE

This application is the U.S. national phase of International Application No. PCT/FR2004/003292 filed on Dec. 17, 2004, which claims priority to French Patent Application No. 0315070 filed on Dec. 19, 2003, the contents of which are incorporated herein by reference.

The invention relates to a method for guiding an automatic cleaning device for a surface submerged in a liquid, in particular the lateral walls and bottom of a swimming pool. The invention also extends to a cleaning device used for this guiding method.

Automatic cleaning devices are already known, comprising:

- a chassis carrying a device for filtration of the liquid (electric pump motor, filtration chamber, pump, inlet(s) and outlet(s), filtering element(s) . . . ,
- units for driving the chassis on the surface to be cleaned,
- motor means comprising at least one electric drive motor supported by the chassis and arranged to transmit motor movement to at least one part of the units for driving,
- electronic supply and control means of each electric drive motor adapted to control reversal of the drive direction of the units for driving.

Current cleaning devices of this type are designed to ensure in the shortest possible time period a complete sweep of all walls (bottom and lateral) of swimming pools or other submerged surfaces.

To this effect, and in particular, the U.S. Pat. No. 4,162,557 describes a cleaning device whereof the reversible motor means are controlled by a random pulse generator which creates reversals of the direction of the supply current of these motor means at random frequencies.

Another automatic device described in the patent FR 2,567,552 itself comprises, in combination, means for sequential reversal of the sense of the supply current for the electric motors likely to cause periodic reversals of said motors and means for sequential interruption of the supply of the pump's electric motor likely to cause periodic stoppages of said pump.

Such cleaning devices in general give total satisfaction as to quality and efficiency in sweeping, when no circumstances counteract their operation. On the contrary, their progress can be interrupted especially by various protruding obstacles relative to the walls of the pool, such as a ladder, filtration block, or by winding up of their supply cable. In this hypothesis, the frequency of which is not inconsiderable, cleaning devices such as currently being designed offer no solution likely to enable them to be freed from their blockage situation.

In practice, human intervention is often necessary to free the cleaning device. Nevertheless, except for periodically monitoring the progress of the cleaning device, this human intervention may intervene a long time after blockage of this device. The first consequence naturally consists of non-execution of complete cleaning of the pool, as programmed by the user. Furthermore, and above all, these blockage situations of the cleaning device result in operating periods during which the motor means and the units for driving are abnormally stressed, and therefore translate into deterioration, or in any case abnormal fatigue of these elements and also notable reduction in their service life.

The patent EP 1 277 897 describes a solution aimed at eliminating the disadvantage mentioned hereinabove, and subsequently its object is a cleaning device fitted with a translation movement sensor supported by the body and adapted to come into contact with the surface to be cleaned, measuring means suitable for detecting effective movement of this sensor and a microprocessor programmed to reverse the direction of displacement of the cleaning device when the measuring means send a signal representative of stopping the movement of the sensor. This sensor can be a wheel applied to the surface to be cleaned, of which the rotation corresponds to the translation movement of the device.

According to this cleaning device, any stoppage of the sensor occurring while the motor means are powered is representative of interruption in the progress of this device, and leads to reversing the motor means which frees the device from its blockage situation. All the same, such a solution requires equipping the cleaning device with elements (sensor de movement, measuring means . . . ) specifically dedicated to managing the blockage situation, and therefore results in the specific manufacturing of cleaning devices whereof the retail cost proves substantially greater to that of standard cleaning devices.

It has also been provided, especially by the device described in the patent EP 0 905 334, to detect blockage of the drive motors in rotation of the cleaning brushes and to deduce blockage of the cleaning device from blockage of these brush motors; in other words, the procedure which consists of reversing the drive motor means of the chassis is initiated when a blockage on the motors of the brushes is detected. Such a solution has a major disadvantage. If the device comes across a filtration ladder, for example, or any other obstacle protruding relative to the walls of the pool, the device will be blocked in its progress, while the brushes will still be driven normally in rotation by the brush motors. The blockage will not be detected, which can cause overheating and the risk of deterioration.

The aim of the present invention is to eliminate this disadvantage, and its main object is to provide a cleaning device designed to manage the abovementioned blockage situations of said device, without requiring any addition of specific material element dedicated to this management.

Another object of the invention is to provide a cleaning device adapted to manage the drive speed of said device, without the addition of any specific material element.

To this effect, the aim of the invention is a method for guiding a cleaning device of the type described hereinabove, said method for guiding being characterized in that:

- at least one electrical variable providing a value representative of the load torque of at least one electric drive motor is measured periodically,
- each value obtained is compared to a predetermined threshold value representative of a maximum acceptable value, and in the event where said threshold value is exceeded for at least one electric drive motor a procedure is initiated, said saving procedure, in which:
- the control at least of this electric drive motor is reversed so as to cause displacement of the device in a direction opposite its initial direction of displacement (which was its own direction prior to triggering of the saving procedure), and
- displacements of the device are controlled, suitable for having it follow a trajectory allowing it to deviate from the initial trajectory it was following at the time said threshold value was exceeded.

According to the invention, managing blockage situations is therefore ensured by measuring at least one electrical variable, such as the intensity of the current providing a value representative of the load torque of the drive motor means of the chassis on the surface to be cleaned. In practice, such a value is directly accessible in the electronic supply and control means, especially on an entry door of the microprocessor of the electronic supply and control means with which current standard cleaning devices are conventionally equipped. This management therefore requires only transformation of the operating of these electronic supply and control means, especially of the microprocessor, adapted to program the latter such that they control a specific saving procedure when the threshold value is exceeded, representative of an abnormal blockage situation.

On the contrary, with the cleaning device described in EP 1 277 897, the invention therefore consists, not of providing the addition of material elements dedicated to managing the blockage situations, but on the contrary, of utilizing the potentials of the elements making up conventional cleaning devices.

Because of this, the invention therefore strives to eliminate a major disadvantage in known cleaning devices at negligible extra cost.

Furthermore, detection of the blockage occurs directly on the drive means of the chassis on the surface to be cleaned. The specialist spontaneously tends to detect the blockage in the zones of the device which regain contact with possible obstacles encountered. This concerns external parts of the device, following the example of fenders. This disadvantage found especially in the document EP 0905 has been eliminated by the claimed invention by focusing directly in the elements which allow the device to be displaced. It should be noted that in the device of the invention, if the blockage occurs by abutting against an element, the unblocking procedure will be activated by detection of the increase in the motor torque on the drive means of the chassis on the submerged surface.

According to an advantageous embodiment, and when said threshold value is exceeded, periodic measurements are taken of the electrical variable(s) representative of the load torque of said motor, and the saving procedure is triggered only if the values obtained remain greater than the threshold value over a predetermined dwell time.

This dwell time in fact leads to avoiding ill-timed triggering of the saving procedure, especially when values greater than the threshold value are obtained during normal operating of the device without a blockage situation, for example representative of a transfer of the device between the bottom wall and a lateral wall of the pool.

Furthermore, to optimize the decision stage of the triggering of each saving procedure, and advantageously, when the threshold value is exceeded, and during the dwell time, the electrical variable(s) representative of the load torque of said motor are measured more often, that is, with a measurement frequency (fixed or variable) greater than (for example by a multiplication factor of the order of 2) the measuring frequency applied in the absence of said threshold value being exceeded. The measuring frequency of the electrical variable(s) representative of the load torque of the motor means in the absence of exceeding said threshold value must be:

- sufficiently high to avoid any possibility of blockage and deterioration of the motor means between two successive measurements; to achieve this a measuring frequency greater than 1 Hz, for example of the order of 10 Hz, is typically sufficient;
- sufficiently low to minimize the performances required for the electronic supply and control means and in particular to be compatible with electronics traditionally utilized.

Therefore, the measuring frequency in the absence of exceeding said threshold value can be that imposed by the other functions utilizing this measurement, for example speed regulation as described hereinbelow.

Therefore, by way of advantageous example, the electrical variable(s) representative of the load torque of the motor means are measured with a frequency of the order of 50 Hz and a measuring frequency of the order of 100 Hz is applied during each dwell time.

Furthermore, and advantageously according to the invention, during the saving procedure periodic measurements are taken of the electrical variable(s) representative of the load torque of said motor (having exceeded the threshold value), and in the event of exceeding the threshold value for a predetermined time period after launching of this saving procedure, interruption of the electrical feed to the motor means is controlled. This additional stage actually results in detecting the possible inefficacy of the saving procedure, for example in the event of winding up the cable, and thus, in this hypothesis, in guaranteeing the integrity of the motor means and the units for driving.

Advantageously and according to the invention, during each saving procedure rotation of the cleaning device suitable to have it deviate from its initial trajectory is controlled.

Furthermore, advantageously and according to the invention, displacement of the cleaning device is controlled in a direction opposite its direction of initial displacement, during a predetermined time period, then at least said motor (having exceeded the threshold value) is again reversed, but in another direction so as to again control displacement of the device in the direction of initial displacement.

The device can be rotated during displacement in the direction opposite the direction of initial displacement and/or during later displacement in the direction of initial displacement, on completion of the saving procedure, and/or during reversal of direction, the device being stopped in place.

In addition, advantageously and according to the invention, during each saving procedure, the displacement of the device in a direction opposite the direction of initial displacement is controlled for a period of less than 30 s, especially of the order of 5 s to 20 s. On completion of this period, the device is again controlled in the direction of initial displacement, to reprise the normal operating mode defined by the electronic supply and control means. Therefore, the total duration of the saving procedure is less than 1 min, especially of the order of 10 s to 30 s.

The choice of the electrical variable(s) to be measured and of the measuring method depends on the type of electrical motor(s) and on the configuration of the electronic supply and control means.

Advantageously, the invention applies to a method for guiding an automatic cleaning device whereof the motor means comprise at least one motor with continuous current feed by means of an electrical current of predetermined average voltage $U_{ave}$.

In this case, periodic measuring of the electrical variable(s) consists advantageously of periodically generating brown-outs of the motor means feed, measuring the electromotor force engendered by these motor means (operating in generators) during each brown-out, and calculating a value representative of the load torque by comparison between the average voltage $U_{ave}$ and the measured electromotor force. In particular, advantageously and according to the invention the difference between the average voltage $U_{ave}$ and the measured electromotor force is calculated, which is proportional to the intensity circulating in the motor, itself representative of the load torque of the motor means.

Advantageously and according to the invention, during each brown-out, the rotation speed of the motor means is calculated, proportional to the electromotor force generated by the latter, this rotation speed is compared to a stored set rotation speed, and in the event of difference between the measured and stored rotation speeds, the average supply voltage $U_{ave}$ is adjusted so as to minimize the difference between the effective rotation speed and the set value.

The invention extends to a cleaning device comprising:

a chassis carrying a device for filtration of the liquid, units for driving the chassis on the surface to be cleaned, motor means comprising at least one electric drive motor supported by the chassis and arranged to transmit motor movement to at least one part of the units for driving, electronic supply and control means of each electric drive motor adapted to control reversal of the drive direction of the units for driving, characterized in that the electronic supply and control means are adapted to:

periodically measure at least one electric variable providing a value representative of the load torque of at least one electric drive motor, comparing each value obtained to a predetermined threshold value representative of a maximum acceptable value, and in the event where said threshold value is exceeded for an electric drive motor:

reversing control at least of this electric drive motor so as to cause displacement of the device in a direction opposite its direction of initial displacement, and control displacements of the device suitable for having it follow a trajectory enabling it to deviate from the initial trajectory it was following when said threshold value was exceeded.

Furthermore, the motor means advantageously comprise at least one motor with continuous current feed by means of an electrical voltage current $U_{ave}$, and the electronic supply and control means are adapted in light of periodic measurements of the electrical variable(s) to periodically generate brown-outs of the motor means feed, measuring the electromotor force engendered by these motor means during each brown-out, and calculating a value representative of the load torque by comparison between the average voltage $U_{ave}$ and the measured electromotor force.

The invention also relates to a method and a device characterized in combination by any or part of the characteristics mentioned hereinabove or hereinbelow.

Figure 2:
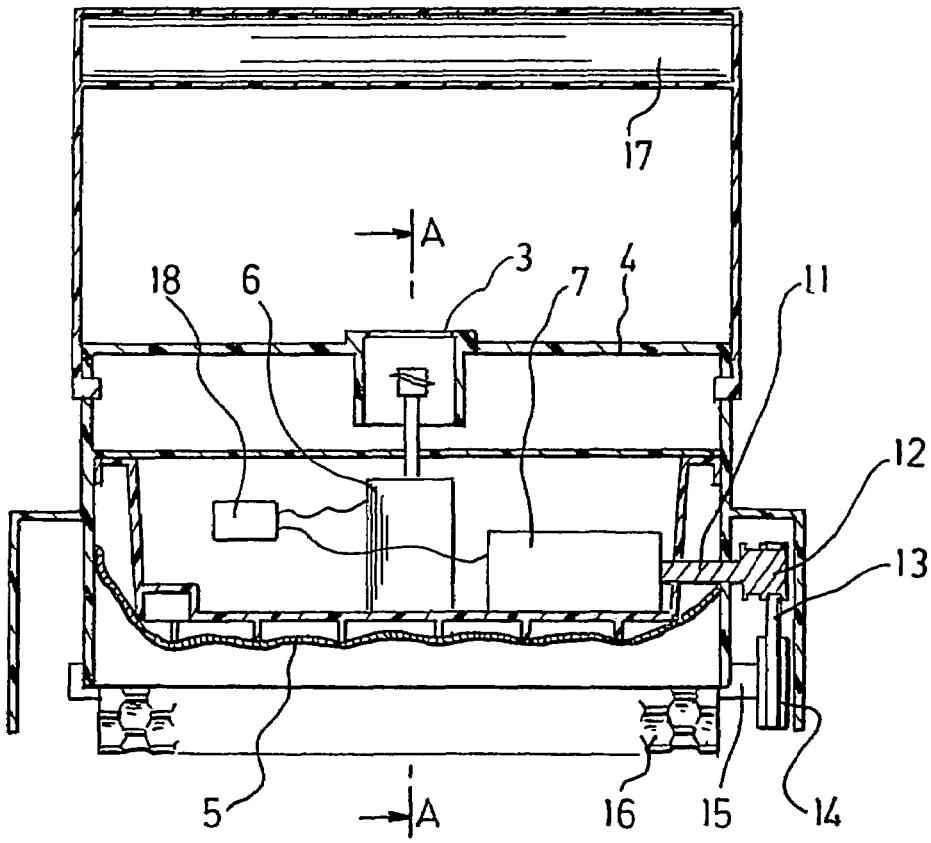

Other characteristics, aims and advantages of the invention will emerge from the following description in reference to the attached diagrams which illustrate by way of non-limiting example a device according to the present invention, in which:

FIG. 1 is a section through a longitudinal axial plane AA of the cleaning device according to the invention, and FIG. 2 in is a section through a transversal plane BB.

The device illustrated by way of example in FIGS. 1 and 2 comprises a chassis 1 constituted by a hollow body 1 open at its base, the latter being equipped with a release cap 2 fitted with induction inlets 2*a* for liquid in the region of the surface to be cleaned.

The body 1 is fitted on its upper part with an expulsion outlet 3 for liquid, located opposite the base of said body so as to force back the liquid in a direction at least substantially orthogonal to the latter, and to the surface to be cleaned.

The body 1 is fitted internally with a tight housing 4 lodged in the latter along its transversal axis as shown in the figures.

This body 1 forms and delimits about the housing 4 a filtration chamber 4*a* equipped with a flexible filtration pouch 5 fixed to the base of the body 1 on the circumference of the cap 2. This pouch 5 is formed by a membrane made of a supple mesh or knitted material of a type known per se.

Furthermore, the housing 4 contains, on the one hand, an electric pump motor 6 arranged in a central zone of the latter, and on the other hand a reversible electric drive motor 7 with continuous current arranged in a transversally eccentric position relative to this central zone. In a variant, not shown here, two distinct drive motors 7 with independent control, one to the left, one to the right, can be provided (as described for example by FR 2818680).

By way of a shaft 8 the pump motor 6 drives a helix or axial pumping wheel 9, which is placed in a guide sleeve 10 of the flux, inserted into the outlet 3. This pump motor 6 therefore circulates the liquid taken at the inlets 2*a* through the filtration chamber to the outlet 3 where the filtered liquid is pushed back.

The drive motor 7 with continuous current drives a transmission wheel 12 by a shaft 11, which wheel is attached by rubberized belts 13 to two wheels such as 14, arranged on two longitudinal ends of the body.

Each of these wheels drives a transversal cylindrical roller 15 sheathed in a flexible sleeve made of alveolar polyurethane foam 16. The two sleeves 16 are arranged to come into contact with the submerged surface and fulfill the double function of engendering progress of the device in one direction or in the other according to the direction of rotation of the motor 7, and ensuring brushing of the surface, tending to loosen the impurities or deposits from the latter, which are then aspirated into the filtration chamber 4*a*.

In addition, a float 17 formed by a hollow cylinder is articulated above the body 1 on the sides thereof in a transversal plane. This float, which can contain a mobile weight such as a plumb bob, cooperates with offsetting the motor 7 to unbalance the device when it is at the level of the water line; it thus determines lateral displacement of the device along this line. The float 17 likewise serves to grip the device during manipulations.

The cleaning device according to the invention finally comprises an electronic card 18 with programmed microprocessor(s), in the first instance, conventionally, to manage the operating of this device, and for example, such as described in the patent FR 2 567 552, to control the execution of cleaning programs during which periodic stoppages of the pump motor 6 and periodic reversal of the drive motor 7 are combined.

According to the invention, this electronic card 18 is in addition programmed to ensure management of optional blockage situations of the cleaning device, and to this effect, to periodically generate brown-outs of the supply of each drive motor 7 with continuous current with a frequency for example of the order of 50 Hz, to measure, during each brown-out, the electromotor force engendered by this motor 7, that is, the electrical voltage E at the electrical supply terminals of this motor 7, to calculate a value representative of the load torque of this motor 7 by comparison between the average supply voltage $U_{ave}$ of the motor 7 and the measured electromotor force, and to compare the calculated value representative of the load torque to a predetermined threshold value.

In the case where the motor means comprise several electric drive motors 7, an electric variable such as mentioned hereinabove for obtaining a value representative of the load torque of only one of these motors can be measured, or on the contrary of all the motors 7. In the latter case, during the saving procedure either just the motor 7, whereof the value obtained has exceeded the threshold value can be reversed, or on the contrary all the motors 7. If the motors 7 are identical, the same threshold value can be used in general. If they are different, then different threshold values will be provided for the different motors 7.

It should be noted that measuring the electromotor force generated by the motor 7 during each brown-out is preferably carried out only after the lapse of a predetermined initial period, for example of the order of 500 μs, of adequate value to ensure that the current circulating in the motor 7 has fallen back to a zero value, therefore independent of the transitory phenomena due to the inductance of the circuit electrical of the motor 7.

An electric variable representative of the load torque is for example the intensity I of the current circulating in the motor, which is given as:

$$I = \frac{1}{R}[U_{moy} - E]$$

where R is in practice a constant of the circuit (corresponding to the electrical resistance). In reality, at the level of the microprocessor of the electronic card 18 this intensity is represented by a numerical variable G whereof the value is proportional to the value of the difference between the average supply voltage $U_{ave}$ and the measured electromotor force E, itself proportional to the value of the intensity and therefore to that of the load torque of the motor 7.

Furthermore, in the case where the variable G exceeds, for at least one drive motor 7, a predetermined threshold value Gmax over a determined time period of the order of 2 to 4 s, the electronic card 18 is programmed to launch a saving procedure. The threshold value Gmax is a numerical value determined by assay from the motor 7 utilized, and previously registered for example in the code of the microprocessor program of the electronic card 18. Gmax represents said predetermined threshold value. The saving procedure consists of:

controlling the reversal of the motor 7 so as to cause displacement of the device in a direction opposite its earlier displacement direction, stopping the motor 7 after a period of time of the order of 15 s, and again controlling reversal of the motor 7, and rotation of the device, for example according to the method described in FR 2 567 552, so as to have it deviate from its initial trajectory.

It should be noted that deviation of the device from its initial trajectory can be obtained otherwise than by the method disclosed in FR 2 567 552. For example, in the case of a device fitted with two distinct drive motors (for example FR 2818680) to the left and right, these motors can be controlled to make the device pivot. There are also devices automatically having different trajectories in one direction and in the other. In this case, a single command to reverse the drive motor(s) will necessarily cause deviation relative to the initial trajectory. In any case, according to the invention displacements of the device are controlled such that it deviates from its initial trajectory to avoid being blocked again.

In the case of a device fitted with two drive motors (to the left and to the right), the choice can be made during the reversal stage of the saving procedure to either reverse only the motor(s) for which the value G exceeds the value Gmax (in which case the device is made to simultaneously pivot), or on the contrary to reverse both drive motors simultaneously.

In addition, once the saving procedure is triggered the electronic card 18 is programmed to continue periodically measuring (for at least part of the duration of the saving procedure, for example of the order of 5 s) the load torque of the motor 7, by brown-out control of the feed to this motor 7, nevertheless at a frequency, for example of the order of 100 Hz, which is greater than the abovementioned current frequency, the latter being for example of the order of 50 Hz. If the results of these measurements reveal the exceeding of said threshold value for a few instants (for example 1 to 3 s) after triggering of the saving procedure, the electronic card 18 is programmed to then control interruption of the feed to motor 7. In effect, such exceeding means an irreparable blockage of the motor 7 which should immediately be shut down.

Finally, the electronic card 18 is also programmed to periodically calculate the rotation speed of the motor 7, proportional to the electromotor force generated by this motor 7, then compare the calculated value with a stored set value, and finally optionally adjust the average supply voltage $U_{ave}$ so as to minimize the difference between the effective rotation speed and the set value.

The cleaning device according to the invention is therefore designed, solely by way of modification of the operating circuit of the electronic card 18, by programming, to ensure on the one hand management of any possible blockage situations of the device, and on the other hand maintaining a set rotation value of the motor 7.

The invention claimed is:

1. A control method of an automatic cleaning device of an submerged surface in liquid comprising:

a chassis carrying a device for filtration of the liquid;

units for driving of the chassis on the submerged surface to be cleaned;

drive motor means of the chassis on the submerged surface comprising at least one electric drive motor of the chassis on the submerged surface, supported by the chassis and arranged to transmit motor movement to at least part of the units for driving of the chassis on the submerged surface;

electronic supply and control means of each electric drive motor of the chassis on the submerged surface, adapted to be able to control reversal of the drive direction of the units for driving of the chassis on the submerged surface, wherein:

at least one electric variable providing a value representative of the load torque of the at least one electric drive motor arranged to transmit motor movement to at least part of the units for driving of the chassis on the submerged surface is measured periodically;

each value obtained at a predetermined threshold value representative of a maximum acceptable value is compared, and in the event where said threshold value is exceeded for at least one electric drive motor of the chassis on the submerged surface, a procedure is triggered, said saving procedure, in which:

control at least of this or these electric drive motors of the chassis on the submerged surface is reversed so as to engender displacement of the device in a direction opposite its direction of initial displacement;

and displacements of the device are controlled, suitable for having it follow a trajectory enabling it to deviate from the initial trajectory it was following when said threshold value was exceeded.

2. The method for guiding a cleaning device as claimed in claim 1, in which when said threshold value is exceeded, periodic measurements are taken of the variable(s) representative of the load torque of the electric drive motor of the chassis on the submerged surface, and the saving procedure is triggered only if the values obtained remain greater than said threshold value during a predetermined dwell time.

3. The method for guiding a cleaning device as claimed in claim 2, in which when said threshold value is exceeded, and during the dwell time, the electrical variable(s) representative of the load torque of the electric drive motor of the chassis on the submerged surface is measured with a measuring frequency greater than the measuring frequency applied in the absence of exceeding said threshold value.

4. The method for guiding a cleaning device as claimed in claim 1, wherein periodic measurements are taken of the electrical variable(s) representative of the load torque of the electric drive motor of the chassis on the submerged surface during each saving procedure, and in the event where said threshold value is exceeded for a predetermined time period after launching this saving procedure, interruption of the power supply of the drive motor means of the chassis on the submerged surface is controlled.

5. The method for guiding a cleaning device as claimed in claim 1, wherein during each saving procedure, displacement of the cleaning device is controlled according to a direction opposite its direction of initial displacement, over a predetermined time period, then at least one of said electrical drive motors of the chassis on the submerged surface is reversed whereof the value obtained has exceeded the threshold value, and rotation of the cleaning device suitable for having it deviate from its initial trajectory is controlled.

6. The method for guiding a cleaning device as claimed in claim 1, wherein displacement of the cleaning device is controlled according to a direction opposite its direction of initial displacement during each saving procedure, during a predetermined time period, then at least one of said electric drive motors of the chassis on the submerged surface is reversed again so as to again control displacement of the device in the direction of initial displacement.

7. The method for guiding a cleaning device as claimed in claim 1, wherein displacement of the device in the direction opposite the direction of initial displacement is controlled during each saving procedure for a period of less than 30 s.

8. The method for guiding a cleaning device as claimed in claim 1, whereof the drive motor means of the chassis on the submerged surface comprise at least one motor with continuous current supplied by means of an electric current of predetermined average voltage $U_{ave}$ wherein periodic measuring of the electrical variable(s) includes periodically generating brown-outs of the feed of the drive motor means of the chassis on the submerged surface, measuring the electromotor force engendered by these drive motor means of the chassis on the submerged surface during each brown-out, and calculating a value representative of the load torque by comparison between the average voltage $U_{ave}$ and the measured electromotor force.

9. The method for guiding a cleaning device as claimed in claim 8, wherein during each brown-out, the rotation speed of the drive motor means of the chassis on the submerged surface is calculated, proportional to the electromotor force generated by the latter, this rotation speed is compared to a stored set rotation speed, and in the event of difference between the measured and stored rotation speeds, the average supply voltage $U_{ave}$ is adjusted so as to minimize the difference between the effective rotation speed and the set value.

10. An automatic cleaning device for an submerged surface in liquid, comprising:

a chassis supporting a filtration device for liquid;

units for driving of the chassis on the submerged surface to be cleaned;

drive motor means of the chassis on the submerged surface comprising at least one electric drive motor of the chassis on the submerged surface supported by the chassis and arranged to transmit motor movement to at least part of the units for driving of the chassis on the submerged surface;

electronic supply and control means of each electric drive motor of the chassis on the submerged surface adapted to be able to control reversal of drive direction of the units for driving of the chassis on the submerged surface, said device being characterized in that the electronic supply and control means are adapted to:

periodically measure at least one electric variable representative of the load torque of the at least one electric drive motor arranged to transmit motor movement to at least part of the units for driving of the chassis on the submerged surface;

compare each value obtained at a predetermined threshold value representative of a maximum acceptable value, and in the event of exceeding said threshold value for at least one electric drive motor of the chassis on the submerged surface:

reversing control at least of this electric drive motor of the chassis on the submerged surface so as to engender displacement of the device in a direction opposite its direction of initial displacement;

and control displacements of the device suitable to have it follow a trajectory enabling it to deviate from the initial trajectory it was following when said threshold value was exceeded.

11. The cleaning device as claimed in claim 10 whereof the drive motor means of the chassis on the submerged surface comprise at least one motor with continuous current, powered by means of an electrical current of predetermined average voltage $U_{ave}$, wherein the electronic supply and control means are adapted, in light of periodic measurements of the electrical variable(s), to periodically generate brown-outs of the supply to the drive motor means of the chassis on the submerged surface, to measure the electromotor force engendered by these drive motor means of the chassis on the submerged surface during each brown-out, and to calculate a value representative of the load torque by comparison between the average voltage $U_{ave}$ and the measured electromotor force.

* * * * *